United States Patent [19]

Dahlin

[11] Patent Number: 4,637,731

[45] Date of Patent: Jan. 20, 1987

[54] DEVICE FOR MAKING POROUS CONCRETE

[75] Inventor: Per O. Dahlin, N. Sillre, Sweden

[73] Assignee: Cellexfabrikerna AB, Ange, Sweden

[21] Appl. No.: 700,701

[22] PCT Filed: Jun. 7, 1984

[86] PCT No.: PCT/SE84/00214

§ 371 Date: Jan. 16, 1985

§ 102(e) Date: Jan. 16, 1985

[87] PCT Pub. No.: WO85/00136

PCT Pub. Date: Jan. 17, 1985

[30] Foreign Application Priority Data

Jun. 20, 1983 [SE] Sweden ..... 8303524

[51] Int. Cl.[4] ..... B28C 5/08

[52] U.S. Cl. ..... 366/64; 366/320

[58] Field of Search ..... 366/64, 320, 67, 310, 366/312, 313, 309, 325, 318

[56] References Cited

U.S. PATENT DOCUMENTS

| | | | |
|---|---|---|---|
| 701,465 | 6/1902 | Cavin | 366/40 |
| 2,509,543 | 5/1950 | Truax | 366/320 |
| 2,587,127 | 2/1952 | Erickson | 366/310 |
| 2,633,340 | 3/1953 | Zagray | 366/51 |
| 2,989,291 | 6/1961 | Bepner | 366/56 |
| 4,448,536 | 5/1984 | Strong | 366/67 |

FOREIGN PATENT DOCUMENTS

| | | | |
|---|---|---|---|
| 1241326 | 5/1967 | Fed. Rep. of Germany | 366/64 |

*Primary Examiner*—Robert W. Jenkins

*Attorney, Agent, or Firm*—Watson, Cole, Grindle & Watson

[57] ABSTRACT

Device for making of porous concrete intended for casting of e.g. elements of buildings, by which mainly cement, water and a frothing agent are mixed at the same time causing air pores in the mixture to be clasted, consisting of a cylindrical mixing-tank (1) in which an impeller (3) is arranged with a rotation axis which coincides with the center axis of the mixing-tank (1) and by which the impeller (3) includes blades (31) that extend helicoidally along the mixing tank (1) by which the helicoidally of each blade is less than 90° over the length of the impeller (3) and by which the blades (31) extend a bit against the center axis of the impeller (3). Each blade (31) consists of two, in direction to the center axis of the impeller (3), reciprocally flat strips (32), which incline against the envelope to the mixing tank (1) so that the front edge in the moving direction of the outer strip (32) is located next to the envelope. Wings (33) are arranged between the strips (32) in each blade which incline against the center axis of the impeller (3).

4 Claims, 9 Drawing Figures

DEVICE FOR MAKING POROUS CONCRETE

BACKGROUND OF THE INVENTION

1. Field of the Invention

The present invention relates to a device for making of porous concrete intended for casting purposes, e.g., for casting portions of buildings such as foundation plates, walls and beams wherein principally cement, water and a frothing agent are simultaneously mixed in a way that air pores are produced in the mixture.

2. The Prior Art

A known method for making porous concrete involves mixing cement, sand, and water in a concrete mixer, after which a separately produced froth is lead into and mixed in the concrete. The concrete mixer constituted by a stationary tank having a rotating mixing screw or similar element therein. The froth is produced by a device in which a frothing agent is mixed with air and eventually water so that a froth with small air bubbles is obtained. A device for producing such a froth is described in the Swedish Patent Publication No. 156215.

In order to obtain a uniform quality of the cast porous concrete, i.e., such that it has a uniform density and strength, it is required that the included raw material be mixed in the right proportions. With continuous production, this has been found to be difficult as careful measurement of the flows of raw material and a watching of the mixing times. Further, an effective mixing of the air is required in order not to overly extend the mixing time.

SUMMARY OF THE INVENTION

The object of the present invention is to provide a device for making porous concrete which is easier to use than known devices and which ensures that a uniform and high quality of the cast porous concrete is achieved. According to the invention the device enables all raw material to be mixed in batches, which means that the raw material can be added in exact quantities. Further, it includes control equipment in the form of a micro-computer by which the mixing time and other mixing parameters can be kept equal for all batches during one and the same casting. The device consists of a cylindrical mixing tank in which an impeller is arranged so that its axis of rotation coincides with the centre axis of the tank, and wherein the impeller includes blades that extend helicoidally along the inner envelope surface of the tank, by which the helicoidallity of each blade is less than 90°, preferably 40°, over the length of the tank and by which the blades extend a bit against the centre axis of the impeller.

Each blade preferably consists of two, in direction to the centre axis of the impeller, reciprocally parallel, flat strips which incline against the envelope of the mixing tank, so that the front edge of the moving direction of the outer strip is located next to the envelope. Between the strips, wings are arranged, by which respective wing is located in a plane which inclines against the centre axis of the impeller. Further, propeller blades preferably are arranged along the centre axis, which extend a bit from the centre axis. The blades preferably are supported by arms, which extend from the centre axis of the impeller and which carry a propeller blade each.

A great advantage with the device in accordance with the present invention is that all raw material can be prepared in one and the same apparatus. As such, there is no need for a special device for producing of froth, instead it is prepared at the same time as the porous concrete. This circumstance also has raised other demands on the design of the device compared with the known devices for making of porous concrete by putting in a prefabricated froth into concrete mixer.

Surprising it has been proved that the characteristics of the invention are deciding in order to carry out the preparation in the one and the same device and obtain an uniform quality of porous concrete besides the advantages that are reached by the batch-wise preparation which is described above. The turbulence which is obtained in the mixture by the blades of the impeller and propeller blades provides a good mixing of the air which is in the tank to provide a porous concrete with uniformly spread pores. The device in accordance with the invention also constitutes a very compact unit which can be easily transported from one place to another, e.g., it can be easily mounted on a vehicle. No extensive training of operating personnel is needed, indeed it can be used by anybody (it can be rented to users, for example).

The invention will be beter understood by reference to the attached drawings, taken in conjunction with the following discussion.

DETAILED DESCRIPTION OF THE PREFERRED EMBODIMENT

Figure 1:
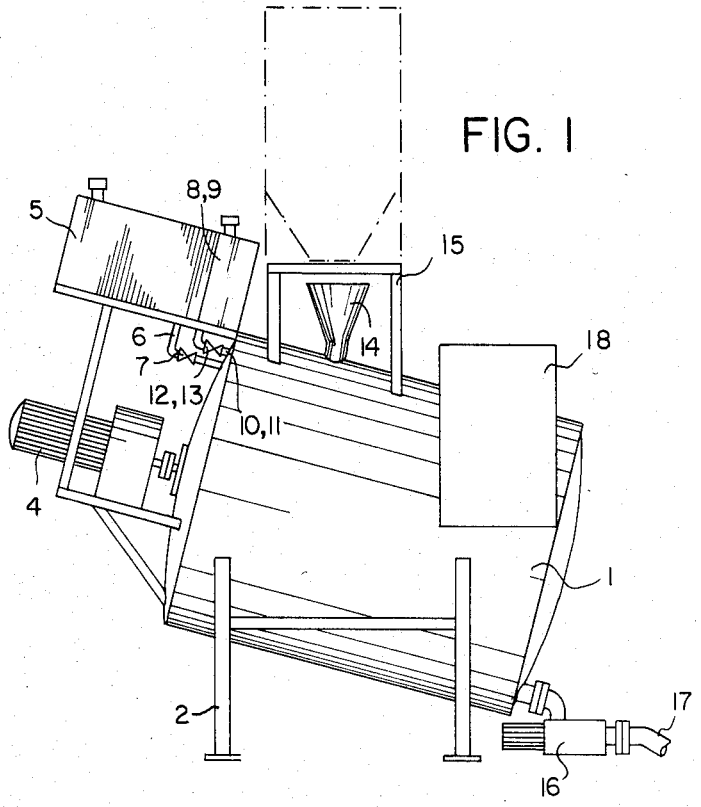
FIG. 1 shows a side view of a concrete mixer according to a preferred embodiment of the present invention.

As shown in FIG. 1, a device according to a preferred embodiment of the invention includes a cylindrical mixing tank 1 which is arranged with an inclining centre axis on a stand 2. The mixing tank 1 has an impeller 3 mounted therein such that its axis of rotation coincides with the centre axis of the tank. The impeller is rotated by a motor 4 which is connected to the impeller 3 at the upper gable of the tank 1. At the top of the upper gable of the tank 1 a water tank 5 is affixed and connected to the mixing tank 1 by a water conduit 6 having a cut-off valve 7. Also in direct connection with the water tank 5 are two tanks 8,9 for frothing emulsion, these tanks being connected to the mixing tank 1 by emulsion conduits 10,11 having cut-off valves 12,13. A funnel 14 for cement is arranged at the top of the envelope of the mixing tank 1 and surrounded by a stand 15 on which a transport container, shown dashed at FIG.

1, is placed at filling up. Downwards at the lower gable of the mixing tank, a pump 16 is arranged for pumping the prepared porous concrete mixture by a flexible hose 17 to the place where the casting is to be carried out. Controlling and watching of the mixing procedure is done by help of control equipment arranged in a locker 18 arranged in direct connection to the mixing tank 1.

Figure 2:
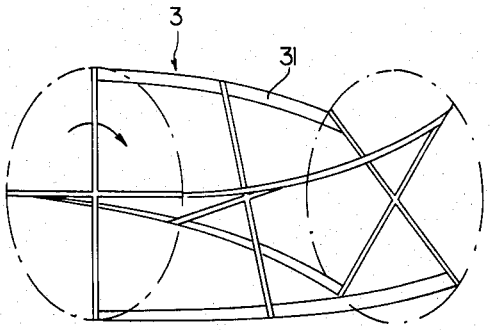
FIG. 2 shows a schematic view of an impeller for the mixer shown in FIG. 1.
Figure 3:
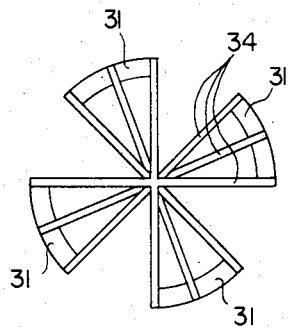
FIG. 3 shows the impeller in accordance with FIG. 2 as seen in the direction of the rotation axis.
Figure 4:
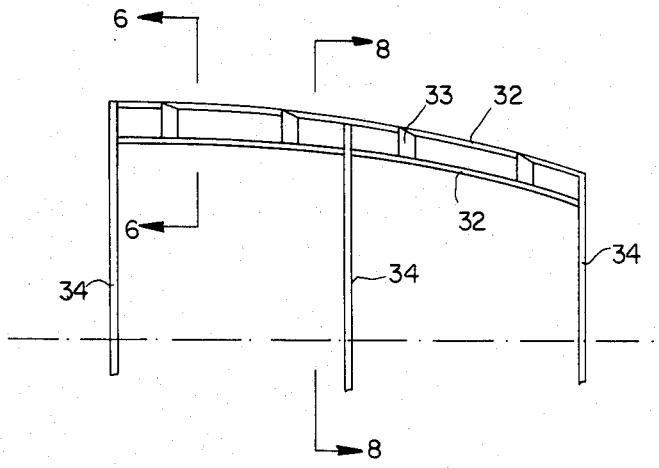
FIG. 4 schematically shows a blade of the impeller in accordance with FIGS. 2 and 3 as seen from one side.
Figure 5:
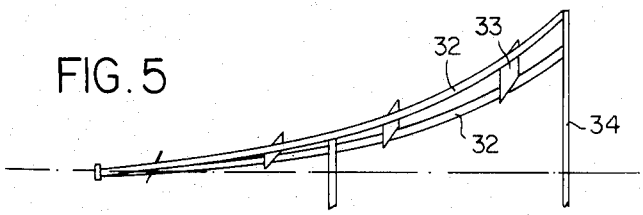
FIG. 5 shows the blade in accordance with FIG. 4 as seen from above.
Figure 6:
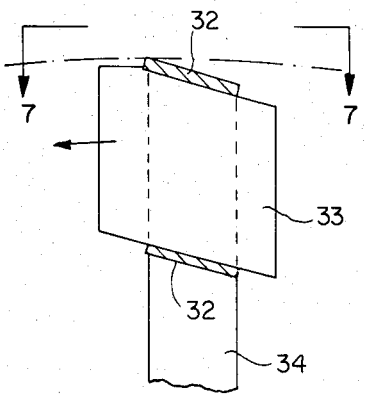
FIG. 6 shows a cross-section of the blade in accordance with FIG. 4 along the line 6—6.
Figure 7:
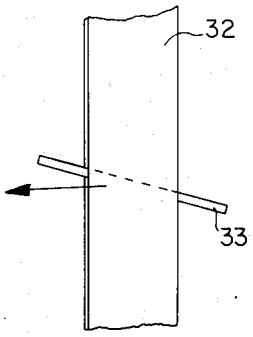
FIG. 7 shows a view over a blade in accordance with FIG. 6 along the line 7—7.
Figure 8:
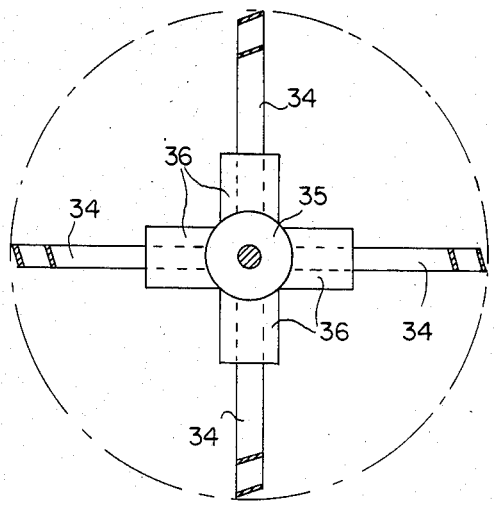
FIG. 8 shows a cross-section of an impeller in accordance with FIG. 4 along the line 8—8, the hub of the impeller also being shown.
Figure 9:
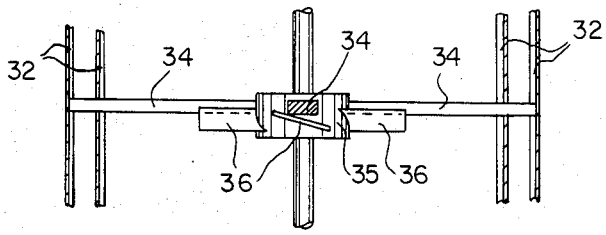
FIG. 9 shows the detail in accordance with FIG. 8 as seen from above.

The impeller 3 comprises four blades 31, which extend helicoidally along the inner envelope surface of the mixing tank 1, by which the helicoidallity in accordance with the example is 45° over the length of the impeller 3 and by which the blades 31 extend a bit against the centre axis of the impeller 3. The helicoidallity is arranged against the direction of rotation which is marked with an arrow in FIG. 2. Further, the left gable of the impeller 3 in accordance with FIG. 2, is arranged at the upper gable of the mixing tank 1 in accordance with FIG. 1. Each blade 31 consists of two, in direction to the centre axis of the impeller, reciprocally parallel, flat strips 32 which are inclined with respect to against the envelope of the mixing tank 1, so that the front edge in the moving direction of the outer strip 32 is located next to the envelope. More specifically, each strip 32 is inclined 15° with respect to the tangent to the rotation circle through the front edge of each strip 32. Between the strips 32, wings 33 are arranged, each wing 33 extending in a plane that is inclined with respect to the centre axis of the impeller 3. The plane through each wing 33 inclines 15° with respect to a plane extending at a right angle to the centre axis of the impeller 3, by which the front edge of each wing 33 is located next to the left cable of the impeller 3, which in its turn is located at the upper gable of the mixing tank 1. The blades 32 are supported by arms 34, which extend from the centre axis of the impeller 3. Four arms 34 are arranged on a hub 35 in a plane at a right angle to the centre axis of the impeller and in reciprocally right angles. Further, at the same hub 35, four propeller blades 36 are arranged which each extend parallel to each arm 34. Each propeller blade 36 is inclined 15° with respect to a plane at a right angle to the centre axis of the impeller 3, by which the front edge of each blade 36 in the same way as the corresponding front edge of the wings 33 in the blades 31 as mentioned above.

During preparation of a porous concrete mixture for casting, a cement container containing a determined amount of cement is placed on the stand 15 on top of the mixing tank 1. The watertank 5 and the emulsion tanks 8,9 are filled up with water and with respective emulsions in proportions corresponding to the amount of cement. The cement after that is manually pulled down into the mixing tank 1 by the funnel 14. After that the control equipment is switched on, by which the valve 7 at the water conduit 6 is opened, causing water to flow into the mixing tank 1. The rotation of the impeller 3 is started and is kept running for a determined time, after which the control equipment opens the valve 12 in the emulsion conduit 10 from the first emulsion tank 8. The running of the impeller 3 is maintained for a determined time, after which the control equipment opens the valve 13 in the emulsion conduit 11 from the second emulsion tank 9. After another determined time of running of the impeller 3, the porous concrete mixture is ready and can be pumped to the location for casting by the pump 16 at the lower end of the mixing tank 1 and by the flexible hose 17, which is connected to the pump 16.

I claim:

1. A device for mixing cement, water and a frothing agent in order to provide a porous concrete for casting, said device comprising a cylindrical mixing tank which defines a central axis line therethrough and which has an interior surface that defines a mixing chamber therein, and an impeller rotatably mounted in said mixing chamber within said cylindrical mixing tank, said impeller having a central axle which coincides with said central axis line of said cylindrical mixing tank, said impeller including a plurality of elongated blades that extend helicoidally with respect to said central axle of said impeller and adjacent said interior surface of said cylindrical mixing tank, each said blade consisting of first and second curved strips which extend in parallel to one another, said second strip being located radially outwardly of said first strip, said second strip being inclined along its length less than 90° with respect to the adjacent interior surface of said cylindrical mixing tank, said second strip having along its length a side edge which is adjacent said interior wall of said cylindrical mixing tank.

2. A device as defined in claim 1, wherein each blade of said impeller includes a plurality of flat wings extending between the first and second curved strips thereof, each wing extending in a plane which is inclined with respect to a plane extending transversely with respect to said central axle.

3. A device as defined in claim 1, wherein said impeller includes a plurality of hubs mounted on said central axle, a plurality of support arms which extend radially outwardly from each said hub, each support arm supporting a respective blade thereon, and a plurality of flat propeller blades which extend radially away from each hub, each said flat propeller blade extending in a plane which is inclined relative to a plane perpendicular to said central axle.

4. A device as defined in claim 1, wherein the helicoidally of each blade is less than 90° around the circumference of said impeller.

* * * * *